US007411079B2

(12) United States Patent
Cadwallader et al.

(10) Patent No.: US 7,411,079 B2
(45) Date of Patent: Aug. 12, 2008

(54) SYNTHESIS OF ESTER LINKED LONG CHAIN ALKYL MOIETIES

(75) Inventors: Dianne Cadwallader, Auckland (NZ); Parag Jhaveri, Mumbai (IN)

(73) Assignee: Meracol Corporation Limited, Auckland (NZ)

( * ) Notice: Subject to any disclaimer, the term of this patent is extended or adjusted under 35 U.S.C. 154(b) by 35 days.

(21) Appl. No.: 10/488,028

(22) PCT Filed: Aug. 31, 2001

(86) PCT No.: PCT/NZ01/00179

§ 371 (c)(1),
(2), (4) Date: Sep. 17, 2004

(87) PCT Pub. No.: WO03/018731

PCT Pub. Date: Mar. 6, 2003

(65) Prior Publication Data

US 2005/0033070 A1 Feb. 10, 2005

(51) Int. Cl.
*C11C 3/00* (2006.01)

(52) U.S. Cl. ..... 554/168

(58) Field of Classification Search ..... 554/168
See application file for complete search history.

(56) References Cited

U.S. PATENT DOCUMENTS 4,049,824 A * 9/1977 Diehl ..... 514/552
5,219,733 A 6/1993 Myojo et al. ..... 435/52

FOREIGN PATENT DOCUMENTS

EP 0678363 A2 10/1995
GB 756549 9/1956
WO WO86/05390 9/1986

OTHER PUBLICATIONS

Nair, Int'l Journal of Toxicology, vol. 16, Supp 1, pp. 123-130, 1997.*
Essentially Pure Ingredients Specification Sheet of Cetyl Myristoleate Complex.*
SEC Filing for Natol for year 2000 as of Mar. 30, 2001.*
Prabhudesal et al., "Preparation and Purification of Wax Esterts—A Different Approach", Chemisrty & Physica of Lipids, vol. 22, pp. 83-86, 1978.*
Nair, Int'l Jour of Toxicology, vol. 16, No. Supp 1, 1997, pp. 123-130, Final report on the safety assessment of cetyl esters.
Prabhudesai et al, Chemistry & Physics of Lipids, vol. 22, No. 1, 1978, pp. 83-86, Preparation and purification of wax esters . . . .

* cited by examiner

*Primary Examiner*—Deborah D Carr
(74) *Attorney, Agent, or Firm*—Jacobson Holman PLLC

(57) ABSTRACT

A process for preparing a mixture of cetyl myristate and cetyl palmitate comprising reacting both myristic and palmitic acid with cetyl alcohol with an acid catalyst and one aromatic hydrocarbon at an elevated temperature and recovering from the aromatic hydrocarbon fraction the cetyl myristate and cetyl palmitate.

15 Claims, No Drawings

SYNTHESIS OF ESTER LINKED LONG CHAIN ALKYL MOIETIES

This is a nationalization of PCT/NZ01/00179 filed Aug. 31, 2001 and published in English.

BACKGROUND

The present invention relates to synthesis of ester linked long chain alkyl moieties. More particularly the present invention comprises an improved synthesis of C12+C14 cetyl ester and to products so synthesised.

Cetyl myristate and cetyl palmitate are useful in the formulation of cosmetics and pharmaceuticals. More particularly, this invention in the synthesis of said cetyl myristate with required palmitate, relates more specially to improved synthesis yields as well as more efficient removal of impurities in the process.

The esters, cetyl myristate and cetyl palmitate are each currently marketed for use in cosmetics and pharmaceuticals.

Cetyl myristate has been produced by an acid catalysed reaction of myristic acid with cetyl alcohol. Cetyl palmitate likewise has been produced by an acid catalysed reaction of palmitic acid with cetyl alcohol. Because of the purity requirements of the cosmetic and pharmaceutical industries each product so synthesised requires extensive and intensive purification procedures.

DESCRIPTION OF THE INVENTION

In one aspect the present invention consists in a process for preparing a mixture of cetyl myristate and cetyl palmitate which comprises, (I) at elevated temperature(s) reacting both myristic acid and palmitic acid with cetyl alcohol in the presence of at least one acid catalyst and at least one aromatic hydrocarbon, and (ii) recovering from the aromatic hydrocarbon fraction the cetyl myristate and cetyl palmitate.

Preferably said elevated temperature(s) are from 65° C. to 140° C.

Preferably the ratios of the reactants is substantially stoichiometric.

Preferably the acid catalyst is one that will predominate (preferably almost exclusively) in an aqueous fraction rather than that of said aromatic hydrocarbon.

Preferably said catalyst is phosphoric acid (preferably 85% phosphoric acid).

Preferably there is an aqueous fraction from which the aromatic hydrocarbon fraction is separated prior to recovering the cetyl myristate & cetyl palmitate from the aromatic hydrocarbon fraction.

Preferably substantially all of the catalyst is retained in the aqueous fraction.

Preferably said aromatic hydrocarbon is of the benzene series and has from six to nine carbon atoms.

Preferably the aromatic hydrocarbon is toluene or xylene (or a mixture thereof).

Preferably the cetyl myristate comprises from about 50 to about 98% w/w of the mixture.

Preferably the recovering of cetyl myristate and cetyl palmitate is by crystallisation and recovery from the aromatic hydrocarbon.

In another aspect our invention comprises a process for preparing a mixture of cetyl myristate and cetyl palmitate, this process includes reacting cetyl alcohol with fatty acids selected from group of C10-C18. admixed with an aromatic hydrocarbon containing from 6 to 8 carbon atoms of the benzene series in the presence of an phosphoric acid at an elevated temperature with agitation for several hours i.e. 8-45 hours. Preferably after the reaction is complete, the desired product is recovered from the aromatic liquid hydrocarbon. One preferred recovering procedure is crystallization and filtration. Alternatively, in another preferred procedure the aromatic liquid can be employed to continuously extract ester from the reaction mixture as the reaction is in progress.

One of the most preferred aspects of the present invention resides in the employment of aromatic non-miscible liquid hydrocarbon. The use of a solvent such as toluene or xylene is superior to any other solvent suggested by the prior art.

In still another aspect the invention consists in a mixture of cetyl myristate and cetyl palmitate produced by a process as previously defined.

In yet another aspect the invention consists in the use of such a mixture in the treatment of inflammatory ailment in a mammal or in a process to produce an oral pharmaceutical composition useful in the treatment of inflammatory ailments.

Preferably one such ailment is asthma.

Preferably the cetyl myristate comprises from about 50 to about 98% w/w of the mixture.

In still a further aspect the present invention consists in an oral composition for treating inflammatory ailments comprising or including both cetyl myristate and cetyl palmitate.

Preferably the composition comprises from 50 to 98% w/w of cetyl myristate with respect to the total weight of cetyl myristate and cetyl palmitate. Preferably the ailment is asthma.

EXPERIMENT A

Hexane Solvent

Myristic acid/palmitic acid, 200 cc. of 85% phosphoric acid and 1800 ml. of hexane were mixed, heated to reflux and then 251 grams of cetyl alcohol added in 30 min. The mixture was refluxed further for 8 hours. Then the hot mixture consisted of a muddy acid layer and a opaque solvent layer which could not be separated by decantation or filtration. The mixture was further diluted with three volumes of hexane causing the slushy hexane layer to further soften enough to be separated from aqueous layer. The hexane layer was then cooled to bring about crystallization of fatty ester. The weight of cetyl myristate isolated was 294 grams which had a melting point of 54-59° C. The conversion, based on the cetyl alcohol used, was 63.71%.

EXPERIMENT B

Heptane Solvent

Myristic acid/palmitic acid, 200 cc. of phosphoric acid, and 1800 ml. of heptane were mixed, heated to reflux and then 251 grams of cetyl alcohol refluxed further for 18 hours and separated as in example A. On crystallization, the cetyl myristate obtained was much darker in colour then in Experiment-A.

It is evident that this process as exemplified by Experiment B is even less satisfactory than that set forth in Experiment-A.

EXPERIMENT C

Alkylation in Absence of a Solvent

Myristic acid/palmitic acid, 400 cc. of 85% phosphoric acid were mixed, heated to 95 C., and 251 grams of cetyl alcohol was added over a period of 30 minutes. The mixture further heated in vacuum and then on cooling. The reaction mixture, which contained a finely divided white solid, was diluted to 3000 ml. with water cooled to 25 C. and filtered. The white product was treated with hot water, and the mixture filtered hot to remove any alcohol.

The unreacted fatty acid was present in a large quantity. The reaction was not complete.

It is quite evident that the entire absence of a solvent in the process results in the complete failure to produce any substantial quantity of said ester.

The following example serves to illustrate the process of our invention in a manner as nearly identical as possible to the process of experiment A. In each of Example 1 and Experiment A, the cetyl myristate was filtered from two liters of Toluene. It is evident that the process employing toluene is far superior:

EXAMPLE 1

Toluene Solvent 1800 cc. of toluene, myristic acid/palmitic acid and 400 cc. of 85% phosphoric acid were mixed, heated to 92° C. and 251 grams of cetyl alcohol was introduced over a 30-minute period. When the addition was complete, the reaction mixture was further refluxed for 38 hours. The hot reaction mixture was a two phase system consisting of a toluene layer and an aqueous phosphoric acid layer. No solid material was present. The hot toluene layer was separated and mixed with charcoal to remove the undesired colouring matter.

The filtrate was cooled to bring about crystallization of cetyl myristate which was isolated by filtration. The weight of cetyl myristate isolated was 436 grams which had a melting point of 54-58° C. The percentage conversion based on the cetyl alcohol employed was 92.3 percent.

The following example serves to illustrate the employment of xylene as the solvent, otherwise similar to Example 1 given above:

EXAMPLE 2

Xylene Solvent

Myristic acid/palmitic acid, 250 grams of 85% phosphoric acid and 1000 cc. of xylene were mixed in a three neck flask provided with thermometer, agitator and reflux condenser. The temperature was increased to 105 with good agitation and 55 grams of cetyl alcohol was introduced over a one-hour period. After the reaction the supernatant xylene layer was drawn off, and the lower phosphoric acid layer was preserved for use in the following run.

The xylene layer on cooling deposited a crystalline solid which weighed 154 gms. This material consisted of cetyl myristate and any unreacted fatty acid. The crude product was easily purified by recrystallization from hot xylene to yield pure cetyl myristate M.P.=54-56° C.

The process of our invention as exemplified by examples 1 and 2 involves the reaction of approximately equimolecular proportions of fatty acid and cetyl alcohol in order to accomplish the most advantageous results. However, higher and lower proportions within the vicinity of ratio of 1:1 can be employed.

The solvent which is employed in accordance with our invention is most advantageously toluene or xylene although other aromatic hydrocarbons of the benzene series containing from six to eight or nine carbon atoms can be employed. The catalyst employed in accordance with our invention is most advantageously phosphoric acid; however, other acid catalysts can be employed. The use of 85% phosphoric acid is advantageously employed in the various examples given; however, equivalent quantities of other strengths of phosphoric acid can also be employed.

The elevated temperature employed in accordance with our process is most advantageously that at which reflux conditions exist. With proper stirring, temperatures which are higher or lower than that by reflux can also be employed. (temperature of from about 65 to about 140° C. can be advantageously employed) The following example will serve to illustrate this aspect of our invention:

EXAMPLE 3

Xylene Solvent

Myristic acid/palmitic acid, 400 cc. of 85% phosphoric acid and 2400 cc. of xylene were mixed in a three neck flask provided with a thermometer, agitator and reflux condenser. The temperature was raised to 105° C. with good agitation and 251 grams of cetyl alcohol was introduced with good agitation over a 1-hour period. The mixture reflux for 36 hour. Next, the supernatant xylene layer was drawn off, and the lower phosphoric acid layer was preserved for use in a subsequent run. The xylene layer on cooling deposited a crystalline solid which weighed 438 grams. This crude material was substantially cetyl myristate and was purified by recrystallization from hot xylene so as to yield pure cetyl myristate having a melting point of 54-56° C.

The water which is formed by the employment of cetyl alcohol in the course of the reaction as in Example 2 dilutes the reaction mixture but can be readily removed by azeotropic distillation of the reaction mixture.

In addition to the procedure illustrated by Examples 1,2 and 3, a successful batch process can be advantageously employed for preparing cetyl myristate with adequate palmitate which comprises, (1) admixing under reflux conditions about one mole proportion of fatty acid from about 1 to about 5 times the same weight of phosphoric acid and from about 1 to about 2 times the same weight of an aromatic hydrocarbon containing from 6 to 8 carbon atoms, (2) maintaining this admixture at its boiling point under good agitation and gradually introducing into this admixture about one mole proportion cetyl alcohol while substantially concurrently removing water by azeotropic distillation, (3) thereafter separating while hot the layer containing the principal part of IC aromatic hydrocarbon from the layer containing the phosphoric acid, (4) then cooling this layer whereby a product consisting primarily of cetyl myristate separates as crystals, and (5) admixing under refluxed condition for 38 hours.

The invention claimed is:

1. A process for preparing a mixture of cetyl myristate and cetyl palmitate which comprises, (i) reacting both myristic acid and palmitic acid with cetyl alcohol in the presence of a catalyst comprising phosphoric acid and at least one aromatic hydrocarbon selected from toluene, xylene and mixture thereof at a temperature of from 65° C. to 140° C., to form an aromatic hydrocarbon fraction containing cetyl myristate and cetyl palmitate, and an aqueous fraction, and (ii) recovering from the aromatic hydrocarbon fraction the cetyl myristate and cetyl palmitate.

2. The process of claim 1 wherein the ratios of the reactants is substantially stoichiometric.

3. The process of claim 1 wherein the acid catalyst is one that will predominate in the aqueous fraction rather than that of said aromatic hydrocarbon.

4. The process of claim 3 wherein the acid catalyst will predominate almost exclusively in the aqueous fraction.

5. The process of claim 1 wherein said catalyst is 85% phosphoric acid.

6. The process of claim 1 wherein the aromatic hydrocarbon fraction is separated from the aqueous fraction prior to recovering the cetyl myristate and cetyl palmitate from the aromatic hydrocarbon fraction.

7. The process of claim 6 wherein substantially all of the catalyst is retained in the aqueous fraction.

8. The process of claim 1 wherein said aromatic hydrocarbon is toluene.

9. The process of claim 7 wherein the aromatic hydrocarbon is a mixture of toluene and xylene.

10. The process of claim 1 wherein the cetyl myristate comprises from about 50 to about 98% w/w of the mixture.

11. The process of claim 1 wherein the recovering of cetyl myristate and cetyl palmitate is by crystallisation and recovery from the aromatic hydrocarbon.

12. A process for preparing a mixture of cetyl myristate and cetyl palmitate, wherein the process includes reacting cetyl alcohol with both myristic acid and palmitic acid admixed with at least one aromatic hydrocarbon selected from toluene, xylene and mixture thereof in the presence of phosphoric acid at a temperature of from 65° C. to 140° C. with agitation for several hours and recovering the mixture from the aromatic liquid hydrocarbon(s).

13. The process of claim 12 wherein the agitation is from 8 to 45 hours.

14. The process of claim 12 wherein recovery is by crystallization and filtration.

15. The process of claim 12 wherein the recovery of the esters is whilst reaction continues.

* * * * *